US007167068B2

(12) United States Patent
Nakano et al.

(10) Patent No.: US 7,167,068 B2
(45) Date of Patent: Jan. 23, 2007

(54) TRANSFORMER

(75) Inventors: Tomoyuki Nakano, Sakai (JP); Kazuhiko Kinutani, Nishikanbara-gun (JP); Hiroshi Ogasawara, Yawata (JP); Mizuto Ida, Hirakata (JP); Yoshiharu Nakamura, Osaka (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/525,199

(22) PCT Filed: Aug. 13, 2003

(86) PCT No.: PCT/JP03/10326

§ 371 (c)(1),
(2), (4) Date: Feb. 22, 2005

(87) PCT Pub. No.: WO2004/019353

PCT Pub. Date: Mar. 4, 2004

(65) Prior Publication Data

US 2006/0066430 A1 Mar. 30, 2006

(30) Foreign Application Priority Data

Aug. 23, 2002 (JP) ..... 2002-244266

(51) Int. Cl.
*H01F 21/06* (2006.01)

(52) U.S. Cl. ..... 336/120; 336/96; 336/192; 335/296

(58) Field of Classification Search ..... 336/120, 336/192; 335/296
See application file for complete search history.

(56) References Cited

U.S. PATENT DOCUMENTS (Continued)

FOREIGN PATENT DOCUMENTS

JP 42-021407 B 10/1967

(Continued)

OTHER PUBLICATIONS

International Search Report for PCT/JP03/10326 mailed on Dec. 24, 2003.

(Continued)

*Primary Examiner*—Elvin Enad
*Assistant Examiner*—Joselito Baisa
(74) *Attorney, Agent, or Firm*—Rader, Fishman & Grauer PLLC

(57) ABSTRACT

A transformer has a bar-shaped ferrite core, an inner winding wound directly around the ferrite core, an outer winding wound over the inner winding, and a dielectric shield surrounding the outer winding. The outer winding has its circumference covered by a dielectric sheath, and has an intermediate winding portion between its winding start end and its winding stop end. The dielectric sheath in the intermediate winding portion is spaced from each other along the axis of the ferrite core to leave thereat a gap which is filled with a molding material. By provision of the gap between the dielectric sheath of the outer winding, the molding material forming the dielectric shield can be easy to flow in between the dielectric sheath of the outer winding and the inner winding, avoiding the void from appearing between the inner and outer windings for attaining stable electrical characteristic.

32 Claims, 12 Drawing Sheets

U.S. PATENT DOCUMENTS

| | | | | |
|---|---|---|---|---|
| 6,680,664 | B1 * | 1/2004 | Fan | 336/83 |
| 2002/0067232 | A1 * | 6/2002 | Oshima et al. | 336/96 |
| 2002/0180572 | A1 * | 12/2002 | Kakehashi et al. | 335/296 |

FOREIGN PATENT DOCUMENTS

| | | | |
|---|---|---|---|
| JP | 54-050922 | A1 | 4/1979 |
| JP | 55-154514 | U | 11/1980 |
| JP | 56-106433 | U | 8/1981 |
| JP | 56-164510 | U | 12/1981 |
| JP | 60-149221 | U | 10/1985 |
| JP | 64-016719 | U | 1/1989 |
| JP | 02-222509 | A1 | 9/1990 |
| JP | 2222509 | * | 9/1990 |
| JP | 03-051806 | U | 5/1991 |
| JP | 04-043615 | A1 | 2/1992 |
| JP | 05-114529 | A1 | 5/1993 |
| JP | 06-055229 | U | 7/1994 |
| JP | 2000-036416 | A1 | 2/2000 |
| JP | 2000-058343 | A1 | 2/2000 |
| JP | 2000-294427 | A1 | 10/2000 |
| JP | 2002-093635 | A1 | 3/2002 |
| JP | 2002-217050 | A1 | 8/2002 |
| WO | WO-02/23561 | A1 | 3/2002 |

OTHER PUBLICATIONS

English translation of International Search Report for PCT/JP03/10326 mailed on Dec. 24, 2003.

* cited by examiner

TRANSFORMER

TECHNICAL FIELD

The present invention is directed to a transformer which gives a high pulse voltage required in a starting device for a high intensity discharge lamp.

BACKGROUND ART

Such transformer is known from Japanese Patent Publication No. 2002-217050 and No, 2002-93635 to include an inner winding placed directly around a bar-shaped ferrite core, an outer winding wound over the inner winding, and a dielectric shield surrounding the windings. The dielectric shield is formed by an injection molding and is made of unsaturated polyester which is a thermosetting dielectric resin and is mixed with a filler enhancing heat-resistance as well as impact-strength.

In the transformer, the outer winding is wound along substantially the full length thereof in a closely relation to the inner winging. In this condition, there appears a substantially closed space within one turn of the outer winding around the inner winding. The substantially closed space is a space into which the dielectric molding resin including the filler is difficult to flow during the injection molding, and therefore remains as a void after forming the dielectric shield. As a result of that the void free from the resin remains, the transformer suffers from a lowered dielectric strength and therefore fails to give an intended voltage difference between the outer and inner windings over a long period of use. For example, in case 800 volts are applied to the outer winding of 5 turns with the inner winding of 200 turns, there is developed a 10 to 20 kV across the inner windings. In the presence of the void between the outer and inner windings, the voltage of 10 to 20 kV is likely to develop a corona discharge responsible for an aged deterioration of the dielectric strength which eventually causes a discharge between the outer and inner windings, thereby failing to give the intended high voltage from the inner winding.

DISCLOSURE OF THE INVENTION

In view of the above insufficiency, the present invention is accomplished to provide a transformer which is capable of restraining the void in a dielectric shield forming a shell of the transformer to give a reliable performance over a long life.

The transformer in accordance with the present invention includes a bar-shaped ferrite core, an inner winding placed around the ferrite core, an outer winding wound over the inner winding, and a dielectric shield surrounding the outer winding. The inner winding is an electrically insulated flat wire having a rectangular cross section and is wounded intimately around the ferrite core with a length of the rectangular cross section extending perpendicular to an axis of the ferrite core. The outer winding has its circumference covered by a dielectric sheath, and has an intermediate winding portion between its winding start end and its winding stop end. The present invention features that the dielectric sheath in the intermediate winding portion is spaced from each other along the axis of the ferrite core to leave a gap thereat, the gap being filled with a molding material. By provision of the gap between the dielectric sheath of the outer winding, the molding material forming the dielectric shield can be easy to flow in between the dielectric sheath of the outer winding and the inner winding, avoiding the void from appearing between the inner and outer windings for attaining stable electrical characteristic.

It is preferred that one turn of the outer winding is spaced along the axis of the ferrite core from the adjacent turns of the outer winding by a distance of 10 μm or more within the intermediate winding portion.

Preferably, each of the winding start end and the winding stop end includes two or more close turns of the outer winding. When the dielectric sheath is of a self-adhesive nature, this arrangement enables to prevent a spring-back unwinding both at the winding start and stop ends prior to molding the dielectric shield. Although the outer winding is wound closely at these ends, the gap is formed in the intermediate winding portion where the outer winding is would loosely is wound loosely so as to allow the molding material to flow from the gap into the closely wound portion, thereby preventing the void from remaining in the winding start and stop ends.

Also, it is preferred that the outer winding is secured on the inner winding by means of an adhesive layer formed on the inner winding for avoiding the spring-back unwinding of the outer winding. A heat-sealing agent can be applied as the adhesive layer.

Further, the outer winding may be secured to the inner winding by means of a heat-sealing layer covering at least one of the outer winding and the inner winding for avoiding the spring-back unwinding of the outer winding.

One turn of the outer winding may have its portion spaced outwardly from the periphery of the inner winding. In this instance, a large open space can be formed between the inner and outer windings so as to be closely packed by the molding material for avoiding the void.

Further, a dielectric spacer may be disposed around the circumference of the inner winding in order to space the outer winding from the inner winding, thereby forming a like large open space between the inner and outer windings to be closely packed with the molding material and preventing the occurrence of the void. In this instance, the dielectric space can be best utilized to have a guide groove which determines the winding direction of the outer winding for facilitating the winding operation of the outer winding. Also, the dielectric space may be provided with a means for retaining the ends of the inner winding around the ferrite core in order to prevent the unwinding of the inner winding by use of the dielectric spacer.

The present application also discloses various advantageous structures with regard to a fixture which is responsible for securing the ends of the inner winding around the ferrite core. The fixture is attached to the ferrite core to retain the ends of the inner winding to predefined portions for avoiding the unintended unwinding.

The fixture is preferably prepared as a cap made of a dielectric resin. The cap is configured to have an opening larger than the end face of the ferrite core, a plurality of projections projecting from the periphery of the opening into the opening to come into abutment against the periphery of the end of the ferrite core for fixing the cap to the ferrite core.

The fixture may be shaped into a resilient plate and is formed around the opening with a slit so that is it given an elastic deformability to vary the size of the opening for facilitating the mounting of the cap on the end of the ferrite core.

The cap is preferably formed with a notch at which the ends of the outer winding are captured. Thus, the single cap can ensure to prevent the unwinding of the inner and outer windings. When the cap is configured to be embedded in the dielectric shield, it can be utilized to position the ferrite core within a molding die used for realizing the dielectric shield, thereby enabling to give the dielectric shield accurately around the inner and outer windings.

The fixture may be configured to have a pair of caps and coupling arms coupling the caps. In this instance, the inner winding can be caught between the caps respectively disposed at the opposite axial ends of the ferrite core to thereby hold both of the winding start and stop ends to the destined positions around the ferrite core.

Preferably, the ferrite core has a cross-section surrounded by two parallel straight lines and two arcuate curves. The coupling arms extend in an axial direction of the ferrite core outside of the arcuate curves so as to give a reduce profile with regard to the height defined between the two straight lines. Further, the coupling arm may be formed with guide grooves which determine the winding direction of the outer winding for facilitating the winding operation of the outer winding. Also, the coupling arm may be formed with a notch which holds the ends of the outer winding for prevention of the unwinding of the outer winding prior to molding the dielectric shield.

Further, the coupling arm may be formed with terminal lugs around which the ends of the outer or inner winding are wound to be held thereat. Thus, the coupling arm can facilitate the connection of the winding to the terminal lugs for an external circuit.

The fixture can be fitted into grooves formed in the end of the ferrite core so as to be secured thereto, and is preferred to have a terminal lug holding the end of the inner winding. The fixture is preferably made of a magnetic material or an electrically conductive material.

Moreover, the fixture may be configured to have a retainer holding the end and a leg inserted between the ferrite core and the inner winding around the ferrite core. In this instance, the leg can be placed in a recess formed in the end of the ferrite core.

The leg may have an inclined surface which bears thereon the inner winding. The inclined surface is configured to give a radial distance from the periphery of the ferrite core which is greater towards the center of the ferrite core than at the one end of the core where the leg is attached. With this arrangement, the inner winding can hold the fixture firmly to the ferrite core so as to retain the fixture on the ferrite core even when the fixture is subject to an external force, during the molding of the dielectric shield, which would otherwise push the fixture away from the ferrite core along the axial direction thereof.

The fixture may be also provided with terminal lugs that hold the inner winding extending out from the periphery of the ferrite core. In this instance, the fixture can be made of a dielectric material, while the terminal lugs are attached to the fixture in an electrically insulating relation to the ferrite core.

Further, the fixture may be configured to have a plurality of legs which are inserted between the ferrite core and the inner winding at a plurality of spots around the end of the ferrite core.

As an alternative means for fixing the ends of the inner winding to the ferrite core, the ferrite core may be formed at a portion adjacent its axial end with notches. A flange is defined between the notch and the end face of the ferrite core such that the inner winding can have its end wound around the notches as being pressed against the flanges for fixing the end of the inner winding around the ferrite core. In this instance, it is preferred that the notch has a bottom of which depth is greater towards the end face of the ferrite core in order to minimize a level difference appearing on the exterior of the inner winding adjacent the notch.

These and other objects and advantages will become apparent from the following description of the embodiments when taken in conjunction with the attached drawings.

BEST MODE FOR CARRYING OUT THE INVENTION

Figure 1:
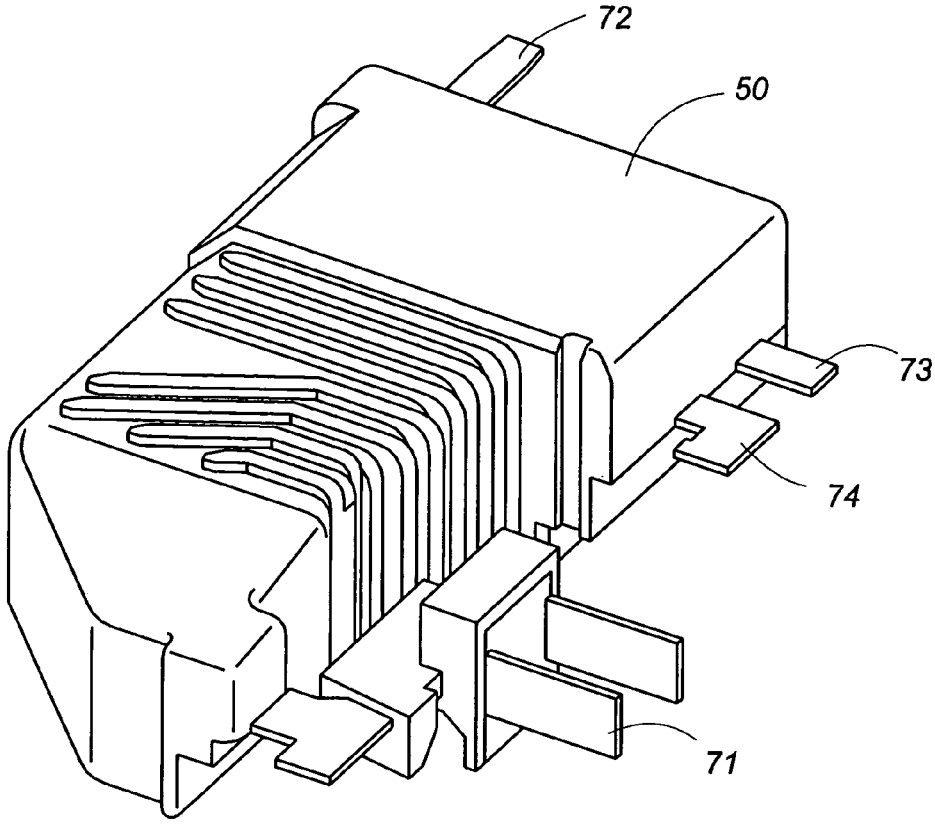
FIG. 1 is a perspective view illustrating an appearance of a transformer in accordance with the present invention.
Figure 2:
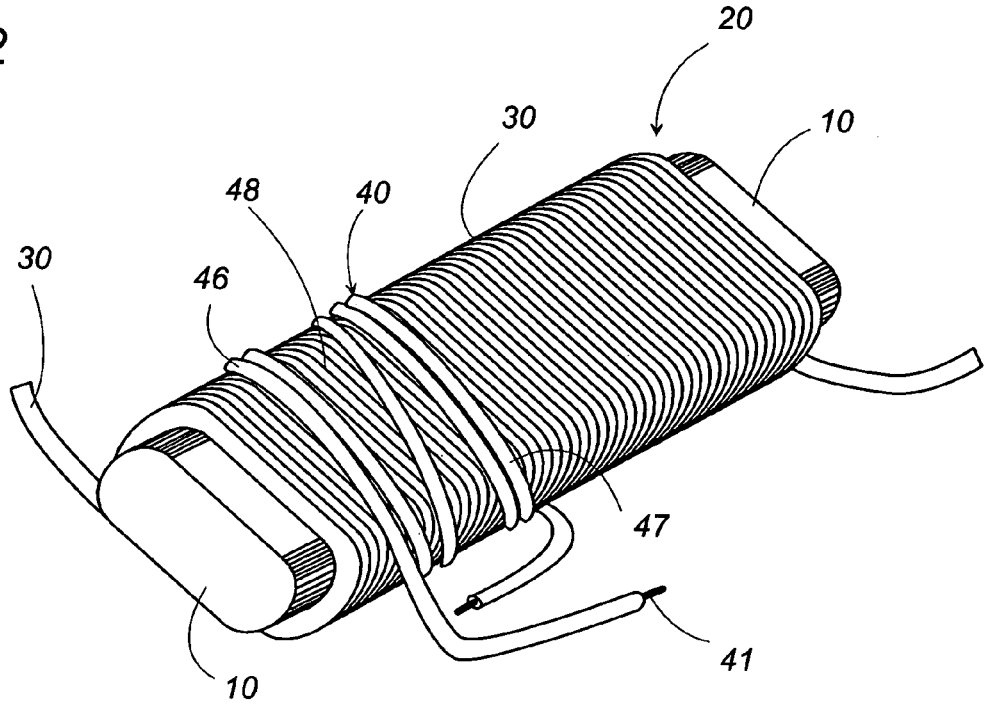
FIG. 2 is a perspective view of an internal structure of the above transformer.

A transformer in accordance with the present invention is designed as an optimal pulse transformer for giving a staring voltage to a discharge lamp for use in a headlamp of a vehicle, and is configured to have a coil block 20 composed of a ferrite core 10 carrying two inner and outer windings 30 and 40, as shown in FIG. 2, and a dielectric shield 50 surrounding the block as shown in FIG. 1.

The inner winding 30 is a so-called flat wire composed of a ribbon conductor covered by a dielectric sheath of a polyimide resin or the like, and is wound directly around the bar-shaped ferrite core 10 in an edgewise fashion. That is, as shown in FIGS. 3 and 4, the inner winding 30 is wound, for example, by 200 turns around the ferrite core 10 with a length of its section crossing with an axis of the ferrite core, and with the wires being close to each other, to constitute a secondary winding of the transformer for developing a high voltage across the ends of the inner winding.

The outer winding 40 is made of a general round conductor 41 covered by a dielectric sheath 42 of fluorine resin or the like, and is wound over the inner winding 30, for example, by 5 turns to constitute a primary winding of the transformer. Upon receiving, for example, 800 V at the primary winding, the secondary winding develops the high voltage of 10 kV to 20 kV across the ends thereof.

The dielectric shield 50 is formed by an injection molding from a thermosetting resin such as unsaturated polyester including a filler so as to surround the coil block 20. Input terminal lugs as well as output terminal lugs, which are provided respectively for connection with the ends of the outer and inner windings 40 and 30, are simultaneously molded into the dielectric shield 50 to be retained thereby.

Figure 3:
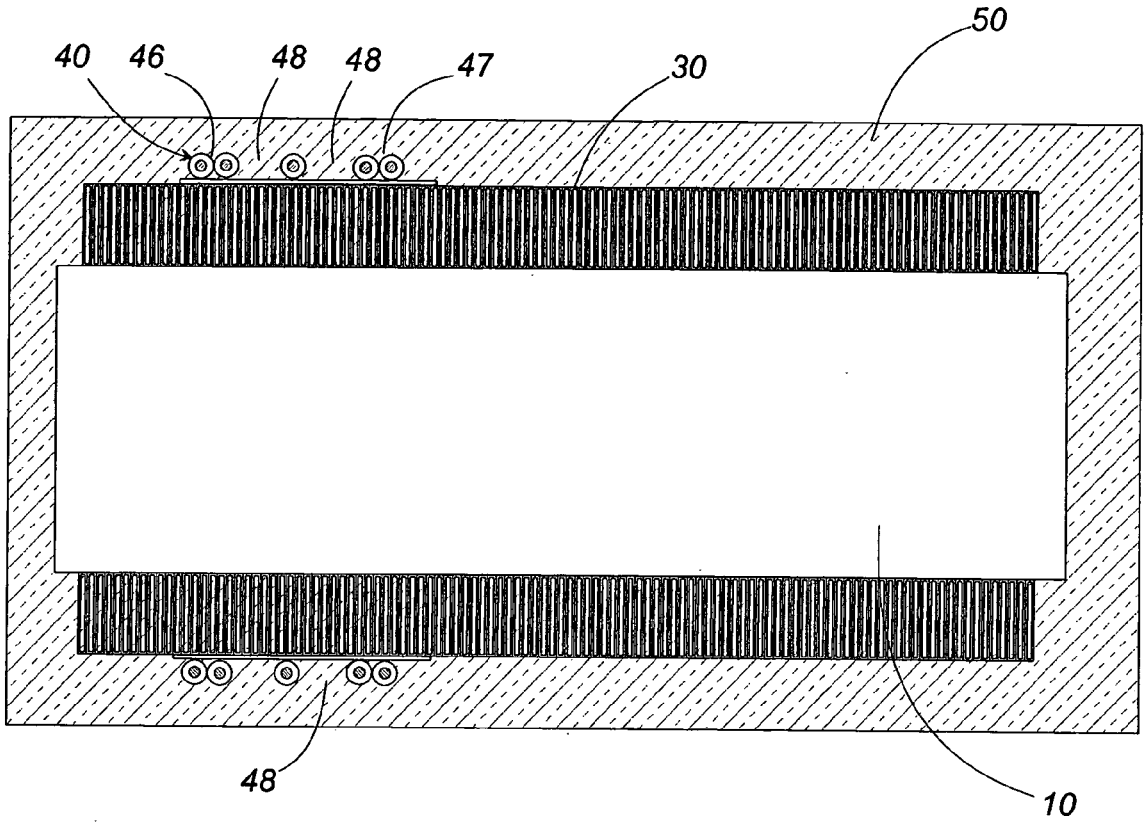
FIG. 3 is a sectional view of the above transformer.
Figure 4:
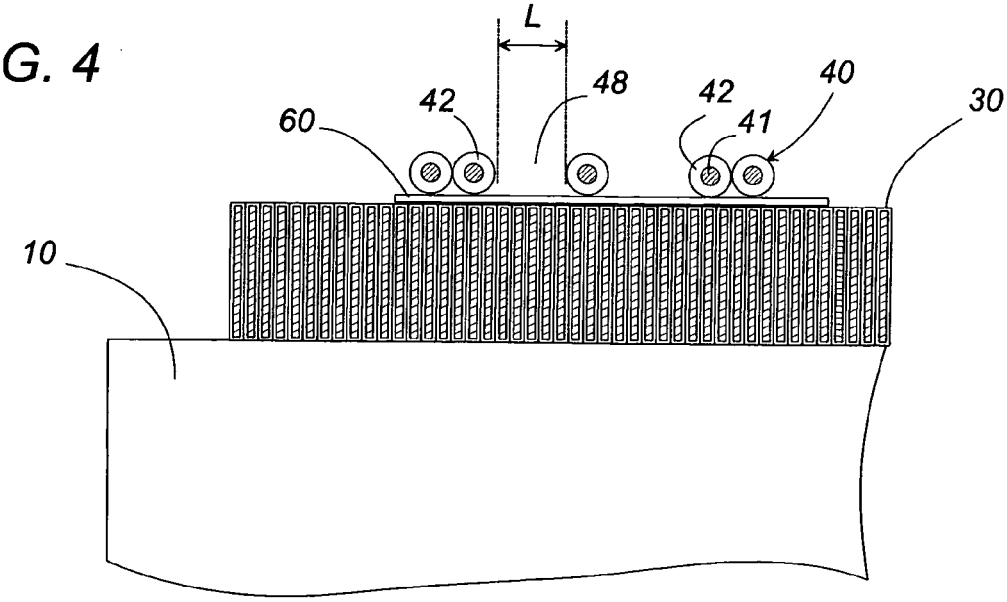
FIG. 4 is a partially enlarged sectional view of the above transformer.

As shown in FIGS. 2 to 4, the outer winding 40 has a winding start end 46 and a winding stop end 47, and is wound over the inner winding 30 in such a manner that the start and stop ends 46 and 47 have their respective dielectric sheaths 42 spaced from each other to leave a gap 48 between the adjacent ones of the winding. The gap 48 has a gap length L of 10 μm or more along the axial direction of the ferrite core 10. In the presence of the gap 48, the injection molding of the dielectric shield 50 can be accompanied with a smooth resin flow in between the outer winding 40 and the inner winding 30, thereby leaving no void which would be troublesome for the transformer operation, and therefore assuring a stable operation characteristic. In order to hold the outer winding 40 over the inner winding 30 prior to molding the dielectric shield 50, the outer winding 40 is wound around the inner winding 30 through a tape 60 coated with an adhesive or a pressure-sensitive adhesive is placed over the inner winding.

Figure 7:
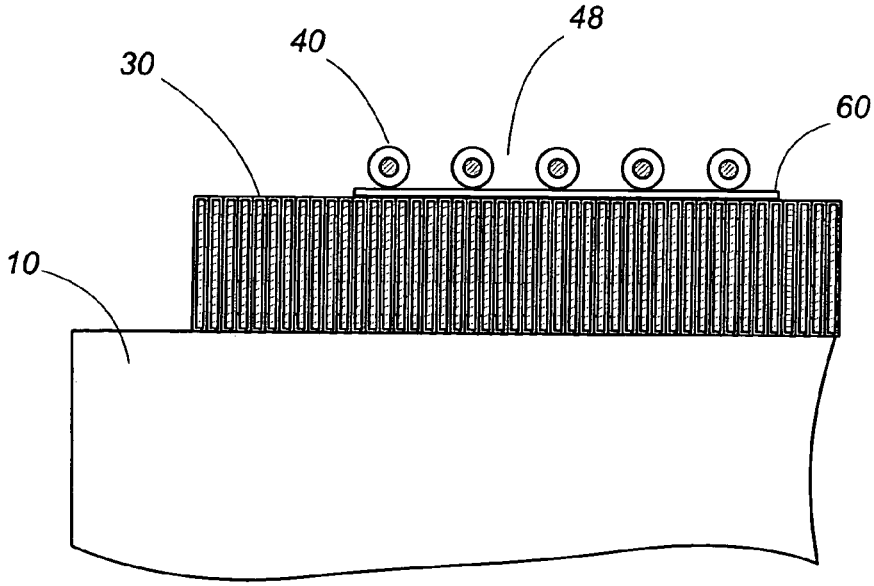
FIG. 7 is a partially enlarged sectional view of a modification of the above transformer.

The winding start and stop ends 46 and 47 are wound respectively by 1 to 2 turns with the respective dielectric sheathes 42 being held intimately to each other so that they are restrained from being unwound. With reduced number of turns, the resin can be forced to flow from the gap 48 into a space between the outer winding 40 and the inner winding 30 at the winding start and stop ends, thereby filling the space successfully with the resin. When the dielectric sheath 42 of the outer winding 40 is made of a fluorine resin having a self-adhesive characteristic, the unwinding at the start and stop ends can be prevented as well. It is noted that, as shown in FIG. 7, the winding start and stop ends may be each configured to have the gap 48. Instead of using the tape 60, the inner winding may be coated with a heat-sensitive agent followed by being wound by the outer winding 40 at a heated atmosphere. It is also possible that at least one of the inner winding 30 and the outer winding 40 is configured to have the heat-sealing dielectric sheath in order to retain the outer winding 40 around the inner winding 30 prior to molding the dielectric shield 50.

Figure 5:
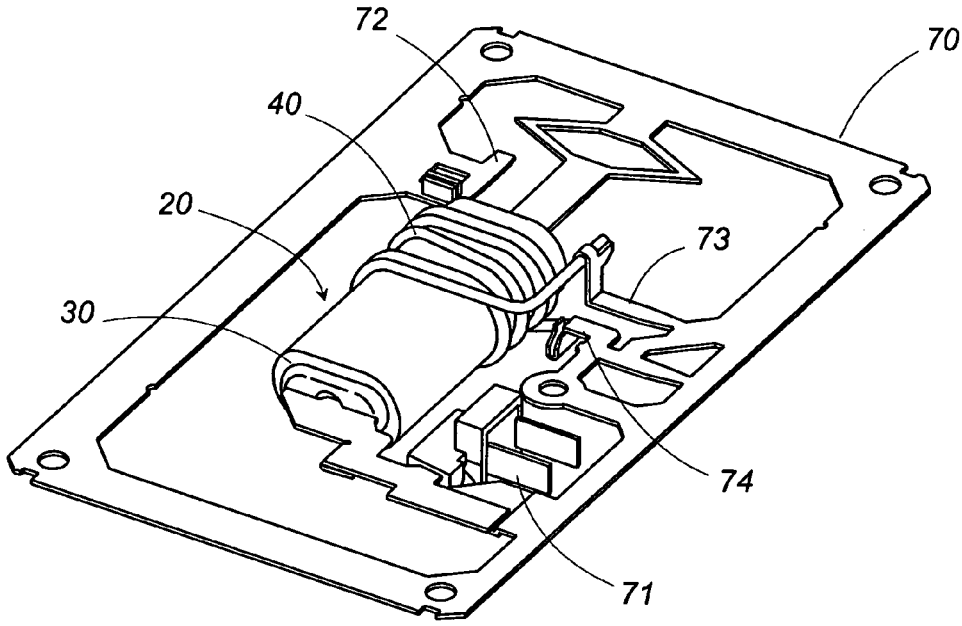
FIGS. 5 and 6 are perspective views respectively illustrating the fabricating steps of the above transformer.
Figure 6:
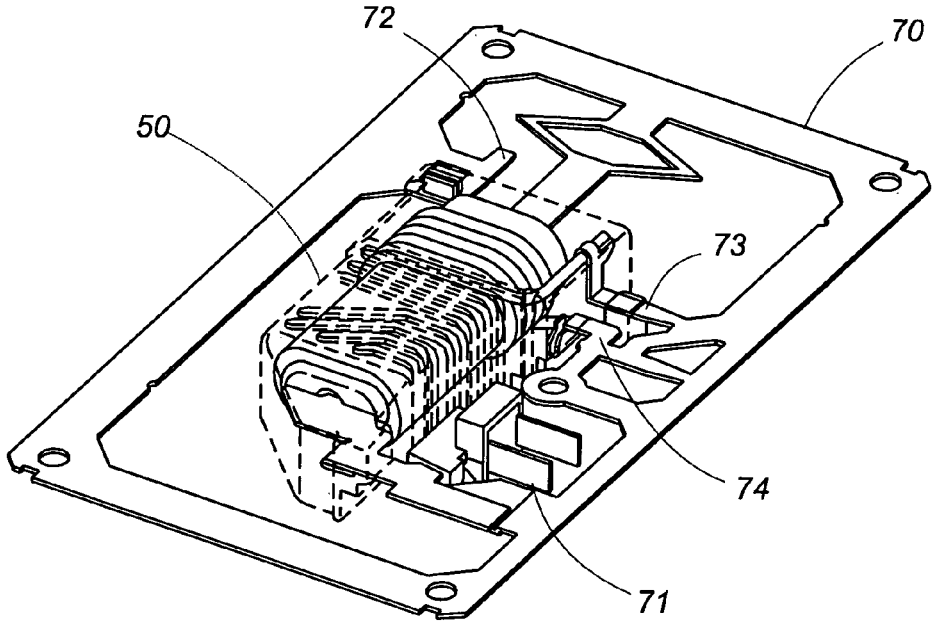

As shown in FIGS. 5 and 6, the dielectric shield 50 is molded by injection over the coil block 20 held in a conductor frame 70 to surround the coil block. The conductor frame 70 includes input terminal lugs 71 and 72, as well as output terminal lugs 73 and 74, all of which are molded in the dielectric shield 50 and are finally detached from the conductor frame 70. Each of the terminal lugs 71 to 74 is formed to have a catch for connection with the end of the inner winding 30 and the outer winding 40.

Figure 8:
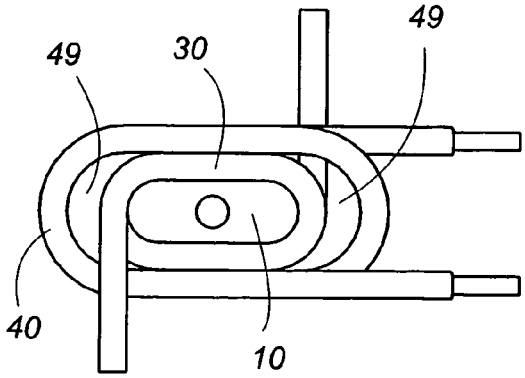
FIGS. 8 and 9 are sectional views respectively illustrating modifications of the above transformer.

FIG. 8 illustrates a modification of the coil block 20 in which the outer winding 40 is wound in such a manner as to leave radially extending gaps 49 outwardly of the inner winding 30. In detail, the inner winding 30 is wound around the ferrite core 10 having a cross-section surrounded by two parallel straight lines and two arcuate curves. The outer winding 40 is held close to straight portions of the inner winding 30, while it is spaced away from the arcuately curved portions of the inner winding 30 to give the gaps between the two windings 30 and 40.

Figure 9:
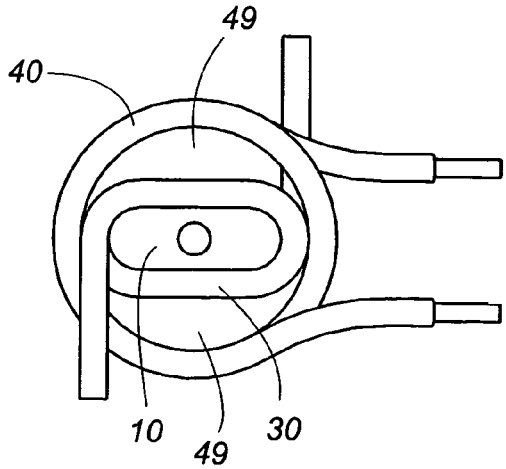

FIG. 9 illustrates another modification of the coil block 20 in which the outer winding 40 is wound in a circular pattern as being in held contact with the arcuate portions of the inner winding 30 and being spaced from the straight portions of the inner winding 30 to leave gaps 49 between the outer and inner windings. In either case, during the injection molding of the dielectric shield 50, the gaps 49 allow the resin to flow successfully into the space between the outer winding 40 and the inner winding 30 and therefore fill the space with the resin without leaving any void.

Figure 10:
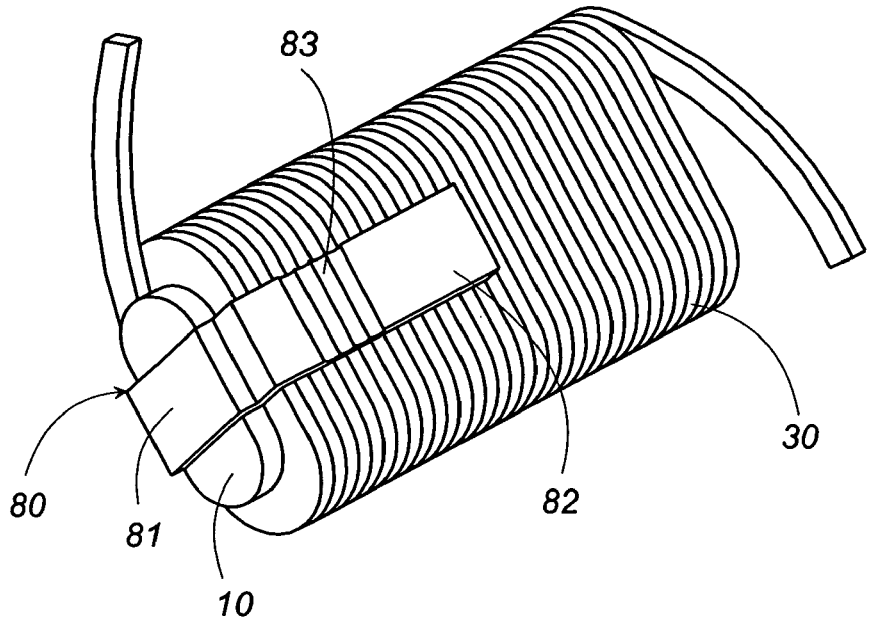
FIG. 10 is a perspective view of a dielectric spacer applicable to the above transformer.

FIG. 10 illustrates a modification in which a dielectric spacer 80 is utilized to create a gap between the inner winding 30 and the outer winding 40. The dielectric spacer 80 is composed of a stopper 81 fitted to the axial end of the ferrite core 10, and a bar 82 extending in the axial direction of the ferrite core 10 over the inner winding 30. The outer winding 40 is wound over the bar 82 to give the gap 49 for successfully flowing the resin in between the outer and inner windings 40 and 30. The bar 82 is formed with guide grooves 83 which receive therein the outer winding to determine the winding direction thereof.

Figure 11:
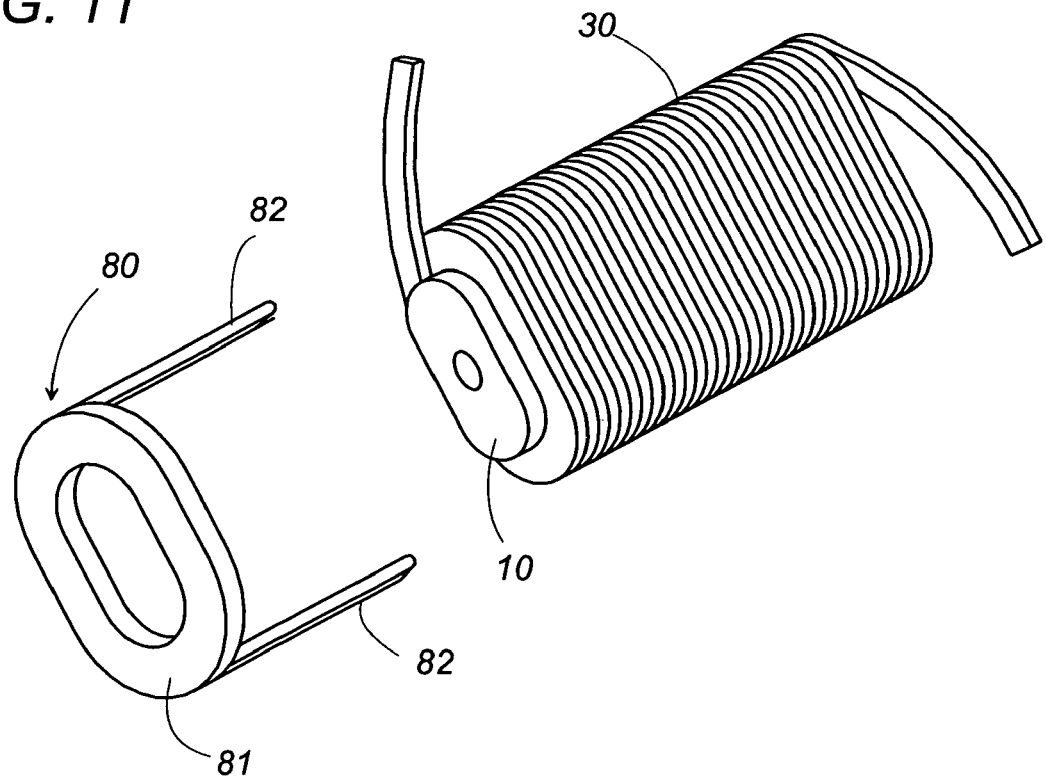
FIG. 11 is a perspective view of another dielectric spacer applicable to the above transformer.

FIG. 11 illustrates another dielectric spacer 80 which is configured to have two bars 82 extending from the stopper 81 fitted to the axial end of the ferrite core 10. The bars 82 act to press the end of the inner winding 30 so as to successfully prevent the unwinding thereof other than a portion already being pulled out, in addition to forming the gap between the inner and outer windings.

Since the transformer of FIGS. 8 to 11 has the outer winding 40 configured to be wound so as to give the radially extending gap, it is expected that the resin can fill thoroughly in the space between the inner winding 30 and the outer winding 40 without necessitating to from the gap in the outer winding 40 itself. Thus, the outer winding 40 can be densely wound.

Figure 12:
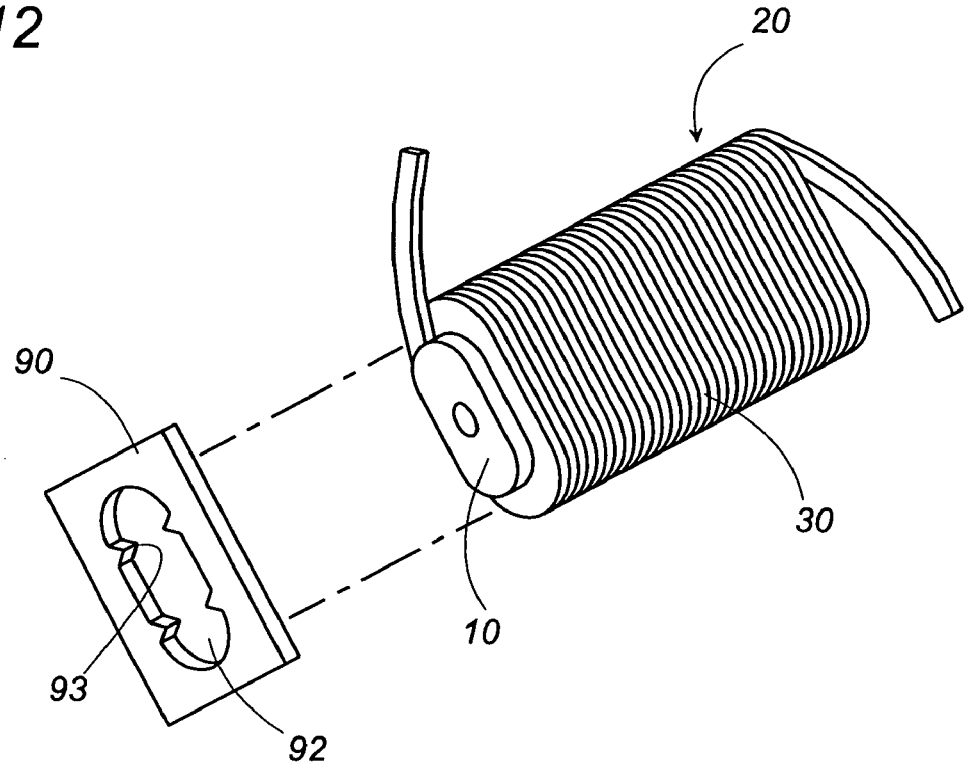
FIG. 12 is an exploded perspective view of a fixture which is utilized in a transformer in accordance with a second embodiment of the present invention.
Figure 13:
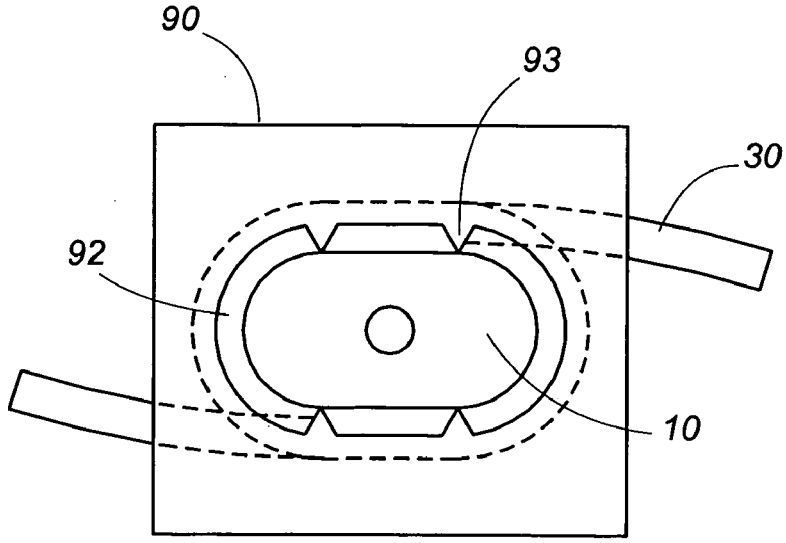
FIG. 13 is an end view illustrating the fixture in its mounted position.
Figure 14:
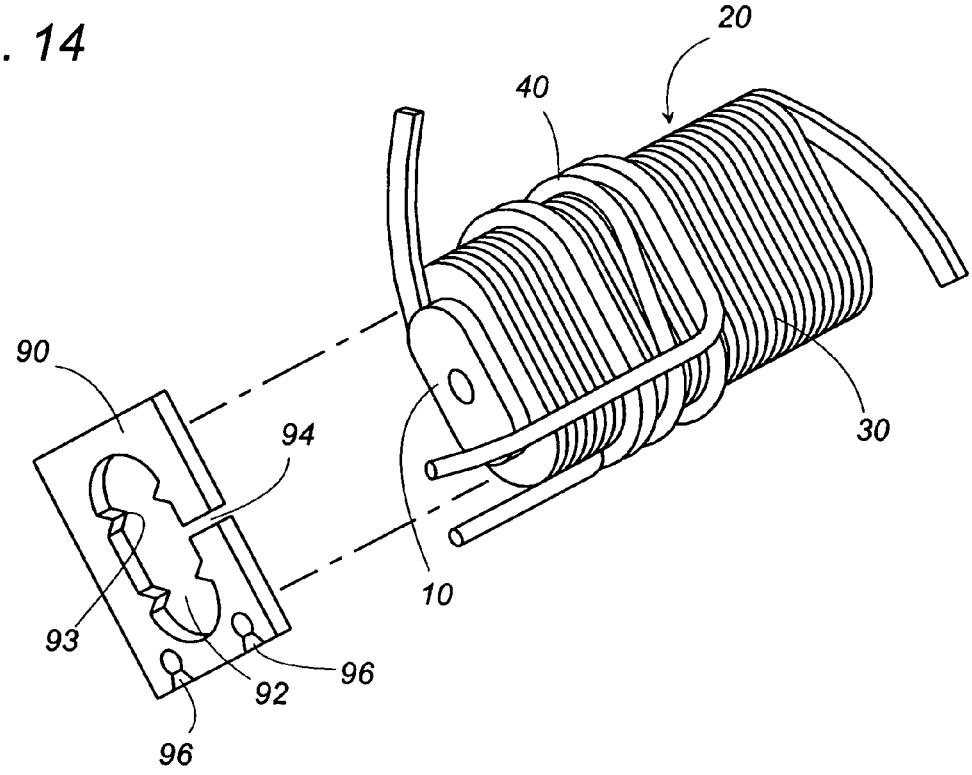
FIG. 14 is an exploded perspective view of a modification of the fixture utilized in the above transformer.

FIG. 12 illustrates a coil block 20 which is utilized in the transformer in accordance with the second embodiment of the present invention, and which is provided with a fixture for preventing the unwinding of the inner winding 30. The fixture includes a cap 90 fitted to the axial end of the ferrite core 10 for prevention of the unwinding. The cap 90 is in the form of a dielectric plate having an opening 92 which is shaped in match with the section of the ferrite core 10, and includes projections 93 on the inner periphery of the opening 92. As shown in FIG. 13, the projections 93 are held against the periphery of the ferrite core 10 to retain the cap 90 to the ferrite core 10, while the cap is pressed against the inner winding 30 in an axially inward direction at its peripheral portion around the opening 92 for preventing the unwinding of the inner winding 30. The cap 90 is shaped into a rectangular configuration in match with internal dimensions of a die for molding the dielectric shield 50, thereby enabling the positioning of the coil block 20 within the die and therefore making it possible to surround the coil block accurately by the dielectric shield 50. Although the figures illustrate the cap 90 mounted to the one end of the ferrite core 10, the ferrite core 10 may be fitted at its both ends with the caps 90. Further, as shown in FIG. 14, the cap 90 may be formed with a slit 94 in order to facilitate the engagement of the ferrite core 10 into the opening 92. As shown in the figure, notches 96 may be formed to retain the ends of the outer winding 40 for preventing the unwinding thereof.

Figure 15:
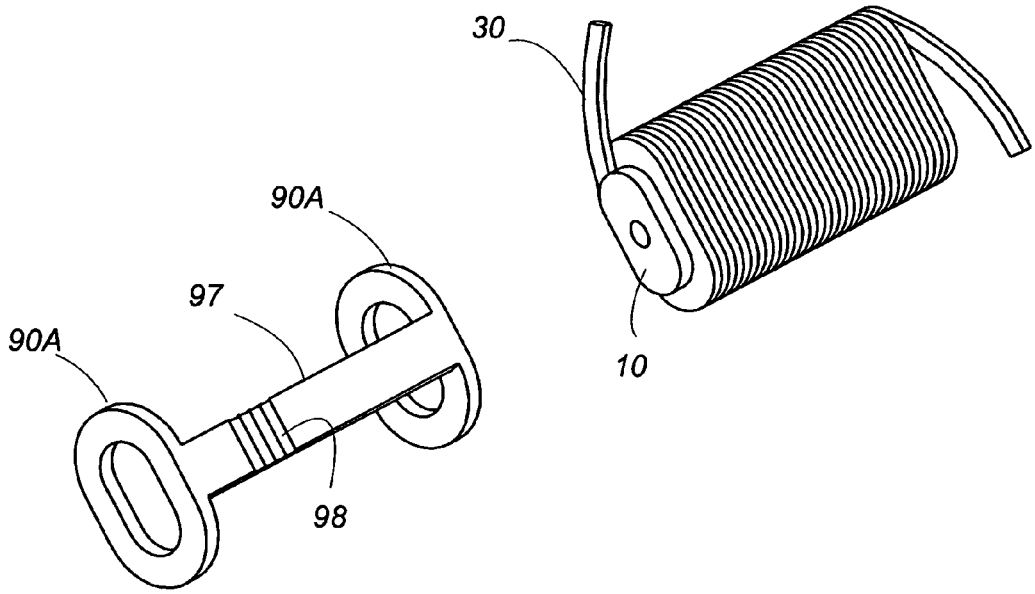
FIG. 15 is an exploded perspective view of another modification of the fixture utilized in the above transformer.

FIG. 15 illustrates another fixture responsible for retaining the ends of the inner winding 30. The fixture includes a pair of caps 90A fitted respective to the opposite axial ends of the ferrite core 10 and a coupling arm 97 interconnecting the caps. Each of the caps 90A is pressed against the end of the inner winding to prevent the unwinding, while the coupling arm 97 is responsible for giving the gap between the inner winding 30 and the outer winding 40, thereby assuring the resin flow during the molding of the dielectric shield 50. The coupling arm 97 is formed with guide grooves 98 which facilitate to determine the winding direction of the outer winding 40. The caps 90A and the coupling arm 97 are integrally molded from a dielectric plastic resin.

Figure 16:
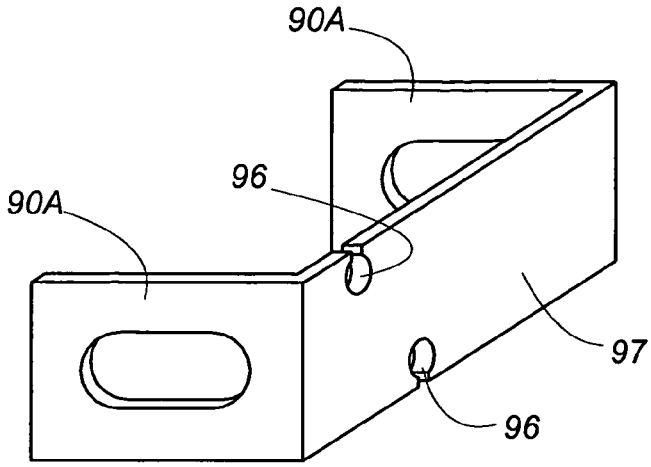
FIGS. 16, 17, and 18 are perspective views respectively of various modifications of the fixture utilized in the above transformer.
Figure 17:
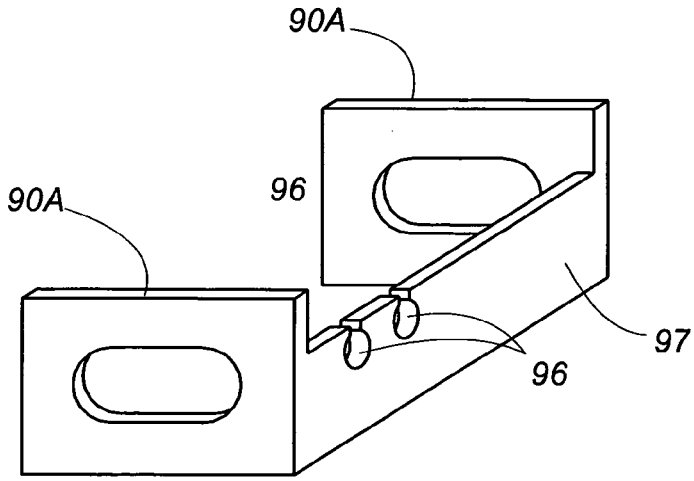
Figure 18:
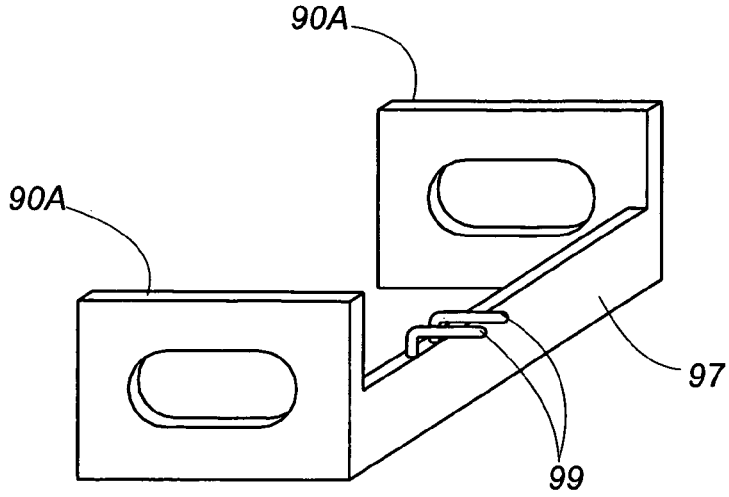

FIGS. 16 to 18 illustrate various modifications of the fixture each including a pair of caps 90A fitted respectively to the opposite ends of the ferrite core 10. The cap 90A is shaped into a rectangular in match with the internal dimensions of the die molding the dielectric shield, while the coupling arm 97 of the caps 90A is formed with notches 96 for retaining the ends of the outer winding 40 or formed with metal segments 99 defining the input terminal lugs for connection with the ends of the outer winding 40. Although not illustrated in the figures, the coupling arm may be formed with terminal lugs for the inner winding or with notches for retaining the ends of the inner winding.

Figure 19:
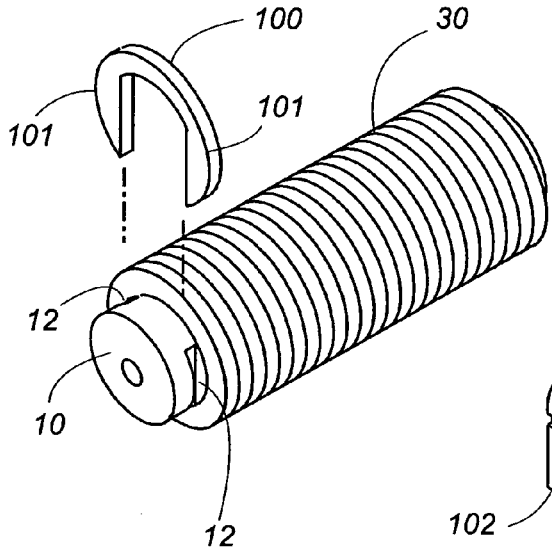
FIGS. 19 and 20 are perspective views respectively of other modifications of the fixture utilized in the above transformer.
Figure 20:
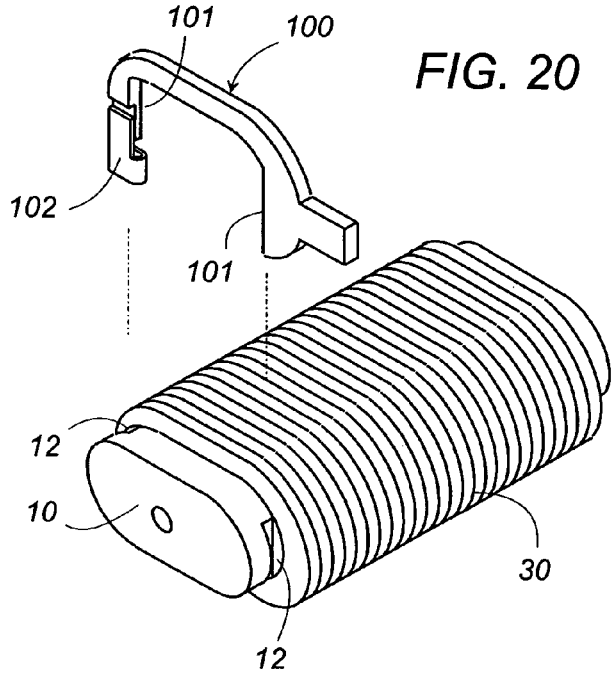

FIGS. 19 and 20 illustrate an example in which the fixture is defined by a stopper 100 which is engaged into slits 12 formed at the end of the ferrite core 10. The stopper 100 is made of an electromagnetic soft iron, the same material from which the ferrite core 10 is made, and has its legs 101 engaged into the slit 12 to be thereby fixed to the ferrite core 10 for press-holding the end of the inner winding 30. The stopper 100 is magnetically coupled to the ferrite core 10 to bend the magnetic flux running through the ferrite core 10 to a direction perpendicular to the axis of the ferrite core, thereby increasing flux linkage between the outer winding 40 and the inner winding 30 and therefore enhancing the electrical characteristic. The stopper 100 shown in FIG. 20 is configured to have a metal terminal lug 102 welded to one of the legs 101 for connection with the inner winding 30. The metal terminal lug 102 may project out of the dielectric shield 50 to serve itself as the terminal lug or to be utilized for connection with another terminal held by the dielectric shield 50. The stopper is attached to each of the opposite axial ends of the ferrite core 10, and may be made from a plastic resin. As explained hereinbefore, since the stoppers 100 are fixed to the ferrite core with respect to the axial direction thereof, they can be kept in the position when the resin flows in the axial direction within the die molding the dielectric shield 50 for successfully restraining the unwinding of the inner winding 30.

Figure 21:
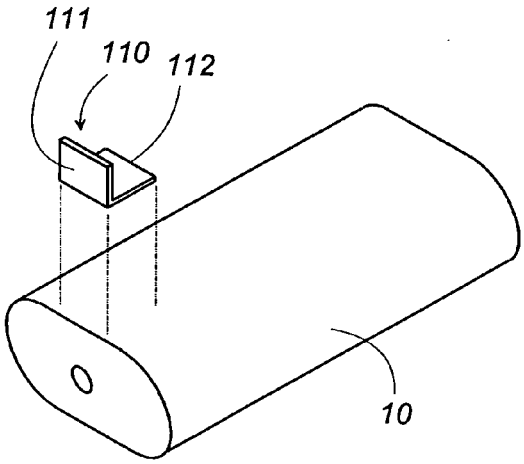
FIG. 21 is a perspective view of a fixture utilized in a transformer in accordance with a third embodiment of the present invention.
Figure 22:
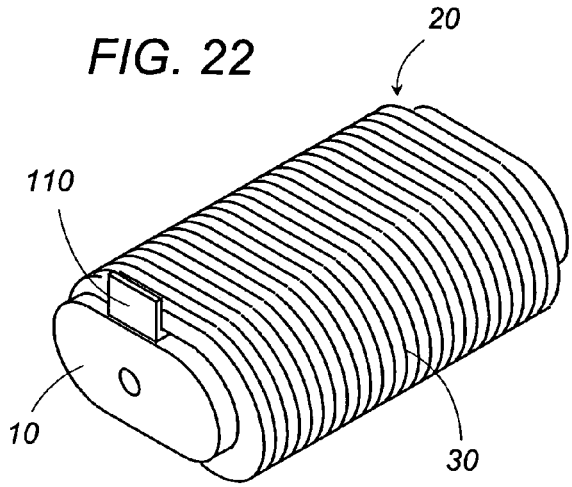
FIG. 22 is a perspective view of the fixture in its mounted position.

FIGS. 21 and 22 illustrates a coil block 20 utilized in the transformer in accordance with a third embodiment of the present invention in which a fixture 110 is disposed on the end of the ferrite core 10 to restrain the unwinding of the inner winding 30. The fixture is composed of a retainer 111 responsible for pressing the end of the inner winding 30, and a leg 112 extending from one end of the retainer 111.

The inner winding 30 is wound over the leg 112 to secure the fixture 110 to the end of the ferrite core 10, which in turn pressing the retainer 111 to the end of the inner winding 30, thereby holding the end of the inner winding at a fixed position for preventing the unwinding thereof. The fixture 110 is applied to each of the opposite axial ends of the ferrite core 10.

Figure 23:
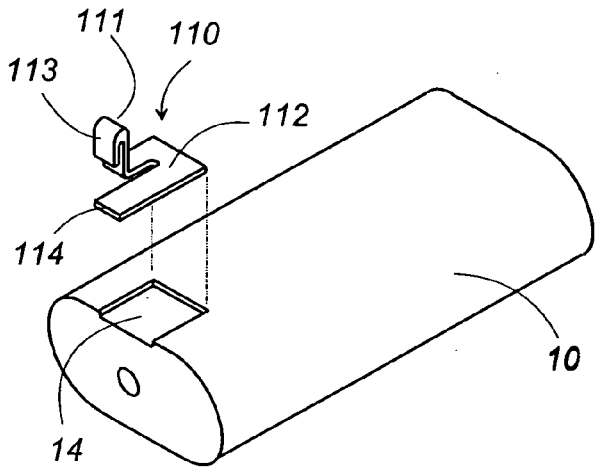
FIGS. 23 and 24 are exploded perspective views respectively of other fixtures applicable to the above transformer.
Figure 24:
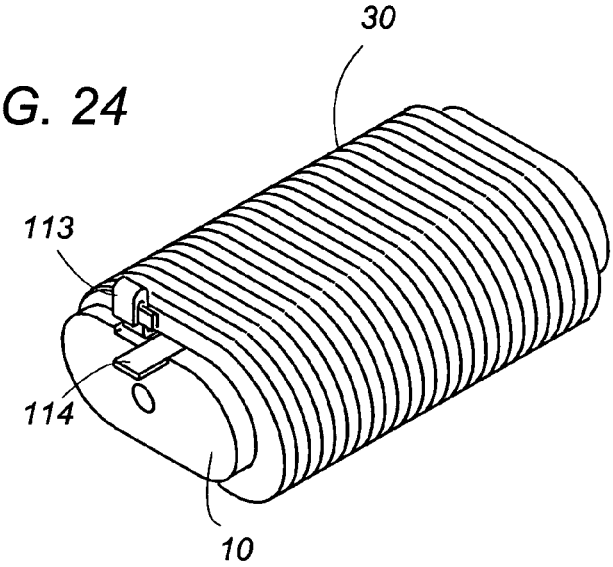
Figure 25:
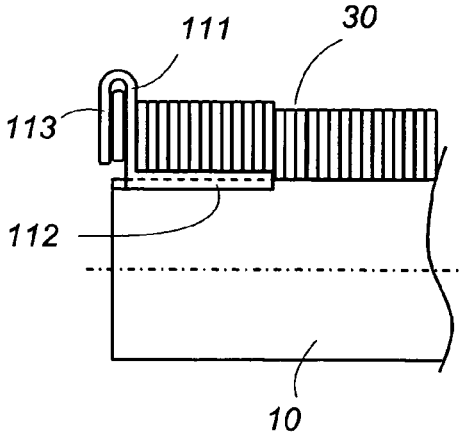
FIG. 25 is a sectional view of the fixture in its mounted position.
Figure 26:
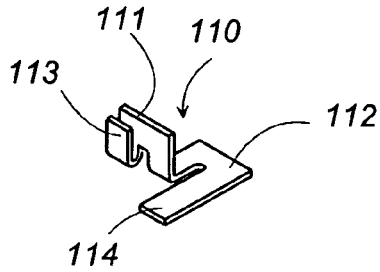
FIG. 26 is a perspective view of another fixture.

FIGS. 23 and 24 illustrate a modification of the above fixture. The fixture 110 is made of an electrically conductive material to have an integral terminal lug 114 and a leg 112 which is received in a recess 14 formed in the end of the ferrite core 10. The leg 112 has a thickness slightly greater than the depth of the recess 14, as shown in FIG. 24, so as to be pressed by the inner winding 30 against the periphery of the ferrite core 10 to be secured thereto. The retainer 111 has a U-shaped hook 113 for connection with one end of the inner winding 30. The terminal lug 114 extends outwardly of the dielectric shield 50 to serve as the terminal lug. The fixture 110 is shown in FIG. 23 to have the U-shaped hook 113 of which open end oriented downward for connection with the winding start end of the inner winding, while the fixture 110 for connection with the winding stop end is configured, as shown in FIG. 26, to have the U-shaped hook 113 of which open end oriented upward. Also for the fixture 110, the terminal lug 114 projects outwardly of the dielectric shield to serve as the terminal lug.

Figure 27:
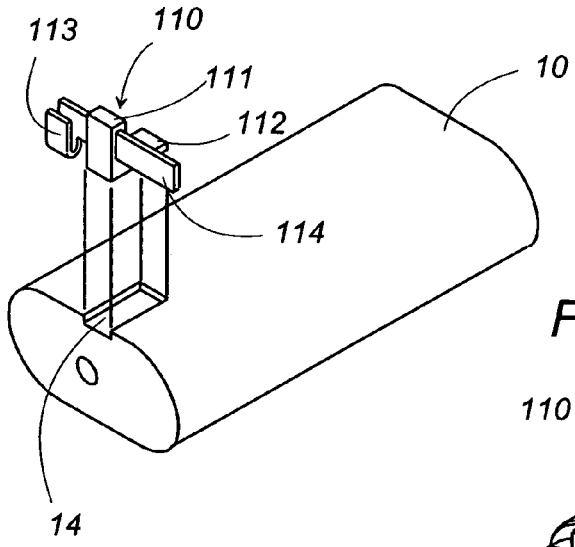
FIGS. 27 and 28 are perspective views respectively of other fixtures applicable to the above transformer.
Figure 28:
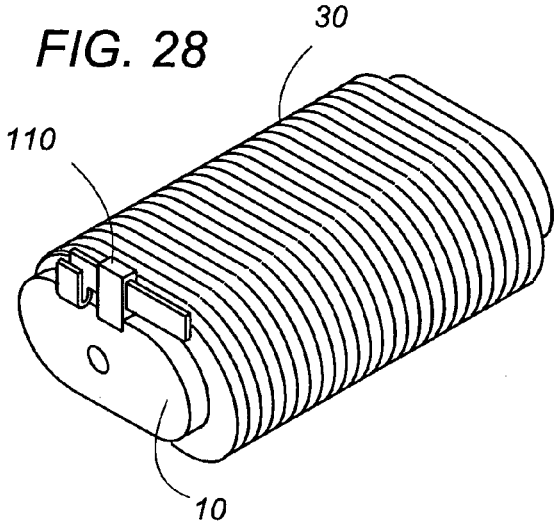
Figure 29:
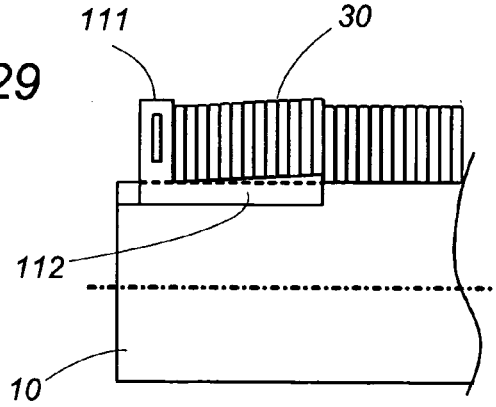
FIG. 29 is a sectional view of the above fixture in its mounted position.

FIGS. 27 to 29 illustrate modifications in which the leg 112 and the retainer 111 of the fixture 110 are molded integrally from a dielectric plastic material to carry the U-shaped hook 113 and the terminal lug 114. By use of the dielectric material for the leg 112 and the retainer 111, it is possible to elongate an insulation distance between the ends of the inner winding 30 as much as possible. Also, as shown in FIG. 29, the leg 112 is shaped to have an inclined surface spaced from the axis of the ferrite core 10 by a distance which becomes greater towards the center than at the axial end of the ferrite core, which is cooperative with the inner winding 30 wound thereover to bring about a wedge action for protecting the fixture 110 from being dropping out of the ferrite core 10.

Figure 30:
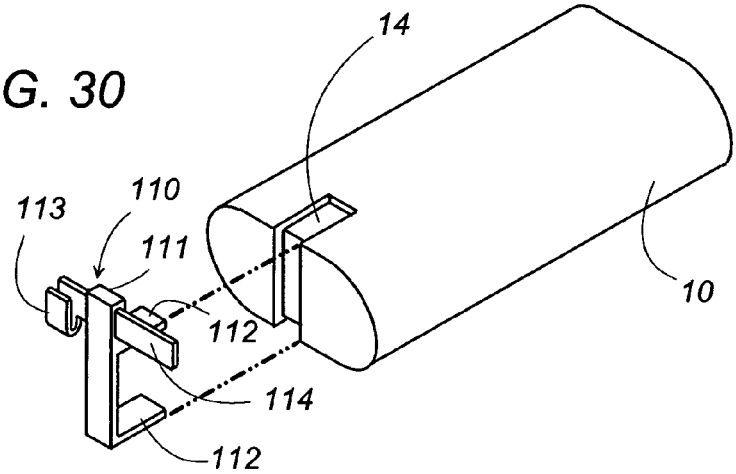
FIG. 30 is a perspective view of a modification of the above fixture.
Figure 31:
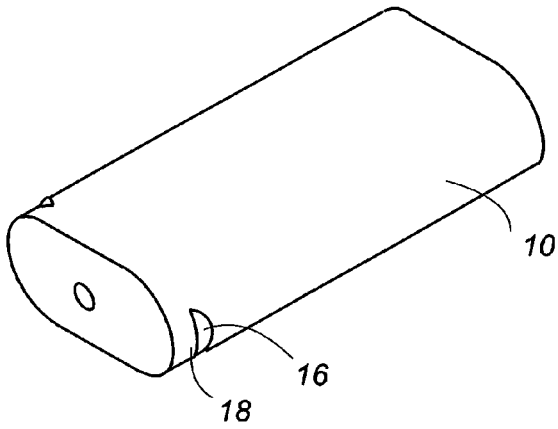
FIG. 31 is a perspective view of a ferrite core utilized in the above transformer.

FIG. 30 illustrates a modification in which the fixture 110 includes a pair of legs 112. In this instance, the ferrite core 10 is formed at its end with a recess 14 extending continuously from the end face to the upper and lower flat faces. The legs 112 come into engagement into the recess 14 in a fashion to bridge across the upper end lower faces by making the use of elastic resiliency given to the portion made of the plastic resin including the legs 112. Thus, the elastic resiliency enables to secure the fixture 110 to the ferrite core 10 easily and firmly, for prevention of the unwinding of the inner winding.

Figure 32:
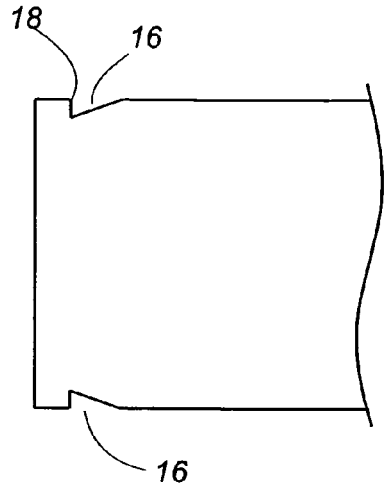
FIG. 32 is a partial plan view of the above ferrite core.
Figure 33:
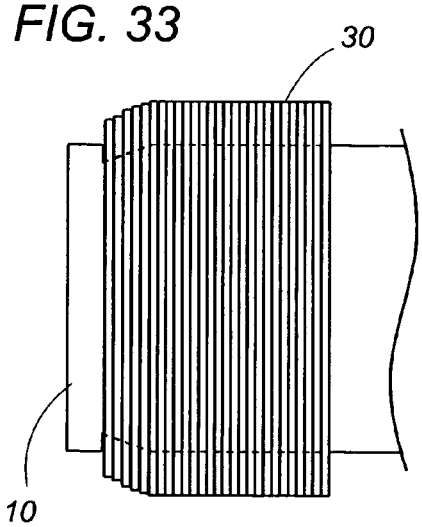
FIG. 33 is a partial plan view of the ferrite core with a winding.
Figure 34:
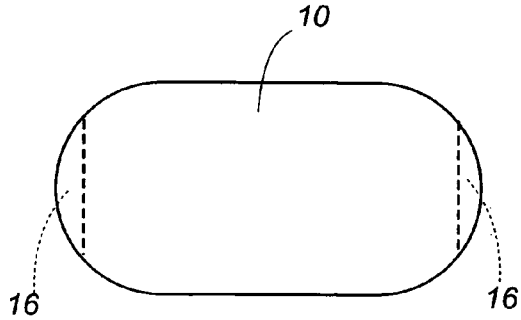
FIG. 34 is an end view of the ferrite core.
Figure 35:
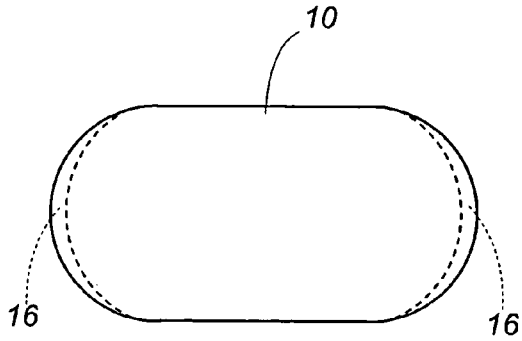
FIG. 35 is an end view of another modification of the ferrite core.

FIGS. 31 to 35 illustrate modifications in which the ferrite core 10 is formed with at its axial end with notches 16 for retaining the end of the inner winding to the ferrite core for preventing the unwinding thereof. The notches 16 are located in the arcuately curved portions in the end of the ferrite core to define flanges 18 between the notches and the axial end of the ferrite core. As shown in FIG. 32, the notch 16 has a bottom of which depth is greater towards the end face of the ferrite core 10. Thus, the end portion of the inner winding 30 wound around the notches 16 is pressed against the flanges 18 to be retained thereby. As shown in FIG. 34, the bottom of the notch 16 may be straight as viewed from the end face of the ferrite core, or may be curved in conformity with the arcuately curved portion, as shown in FIG. 35. In the latter case, the inner winding 30 can be smoothly wound as being entrapped in the catches 16.

The invention claimed is:

1. A transformer comprising:

a bar-shaped ferrite core;

an inner winding placed directly around said ferrite core, said inner winding being an electrically insulated flat wire having a rectangular cross section and being wounded intimately around said ferrite core with a length of the rectangular cross section extending perpendicular to an axis of said ferrite core;

an outer winding wound over said inner winding;

a dielectric shield made of a molding material, said dielectric shield being molded over said outer winding, said inner winding, and said ferrite core for sealing the same inside of said shield;

a pair of output terminals connected across said inner winding and exposed on said dielectric shield; and a pair of input terminals connected across said outer winding and exposed on said dielectric shield;

wherein said outer winding has its circumference covered by a dielectric sheath, wherein said outer winding has an intermediate winding portion between its winding start end and its winding stop end, said dielectric sheath in said intermediate winding portion being spaced from each other along the axis of said ferrite core to leave a gap thereat, said gap being filled with said molding material, wherein one turn of said outer winding is spaced along the axis of said ferrite core from the adjacent turns of said outer winding by a distance 10 μm or more within said intermediate winding portion, wherein each of said winding start end and said winding stop end includes one to two close turns of said outer winding, wherein said dielectric sheath of the outer winding is made of a self-adhesive resin.

2. The transformer as set forth in claim 1, wherein said outer winding is secured to said inner winding by means of a heat-sealing layer covering said inner winding.

3. The transformer as set forth in claim 1, wherein one turn of said outer winding has its portion spaced outwardly from the periphery of said inner winding.

4. The transformer as set forth in claim 1, wherein a dielectric spacer is disposed around the circumference of said inner winding to space said outer winding from said inner winding.

5. The transformer as set forth in claim 4, wherein said dielectric spacer is formed with a guide groove determining the winding direction of said outer winding.

6. The transformer as set forth in claim 4, wherein said dielectric spacer is provided with a means for retaining the ends of said inner winding around said ferrite core.

7. The transformer as set forth in claim 1, wherein a fixture is attached to said ferrite core for fixing the ends of said inner winding around said ferrite core.

8. The transformer as set forth in claim 7, wherein said fixture is a cap made of a dielectric resin which has an opening larger than the end face of said ferrite core, a plurality of projections projecting from the periphery of said opening into said opening to come into abutment against the periphery of the end of said ferrite core for fixing said cap to said ferrite core.

9. The transformer as set forth in claim 8, wherein said cap is shaped into a resilient plate and is formed around said opening with a slit for elastically varying the size of said opening.

10. The transformer as set forth in claim 8, wherein said cap is formed with a notch at which the ends of said outer winding are captured.

11. The transformer as set forth in claim 8, wherein said cap is embedded in said dielectric shield.

12. The transformer as set forth in claim 7, wherein said fixture comprises a pair of caps and coupling arms for coupling said caps, said inner winding being held between said caps.

13. The transformer as set forth in claim 12, wherein said ferrite core has a cross-section surrounded by two parallel straight lines and two arcuate curves, said coupling arms extending in an axial direction of said ferrite core outside of said arcuate curves.

14. The transformer as set forth in claim 12, wherein said coupling arm is formed with guide grooves for determining the winding direction of said outer winding.

15. The transformer as set forth in claim 12, wherein said coupling arm is formed with a notch which holds the ends of said outer winding.

16. The transformer as set forth in claim 12, wherein said coupling arm is formed with terminal lugs around which the ends of said outer winding are wound to be held thereat.

17. The transformer as set forth in claim 12, wherein said coupling arm is formed with terminal lugs around which the ends of said inner winding are wound to be held thereat.

18. The transformer as set forth in claim 7, wherein said fixture is fit into grooves formed in the end of said ferrite core so as to be secured thereto.

19. The transformer as set forth in claim 18, wherein said fixture is made of a magnetic material.

20. The transformer as set forth in claim 18, wherein said fixture is provided with a terminal lug for retaining the end of said inner winding.

21. The transformer as set forth in claim 18, wherein said fixture is made of an electrically conductive material.

22. The transformer as set forth in claim 7, wherein said fixture comprises a retainer holding the end of said inner winding and a leg inserted between said ferrite core and said inner winding wound around said ferrite core.

23. The transformer as set forth in claim 22, wherein said ferrite core is formed in its end with a recess for receiving said leg.

24. The transformer as set forth in claim 22, wherein said leg has an inclined surface which bears thereon said inner winding, said inclined surface being configured to give a radial distance from the periphery of said ferrite core which is greater towards the center of said ferrite core than at the one end of said core where said leg is attached.

25. The transformer as set forth in claim 7, wherein said fixture is provided with terminal lugs that hold the inner winding extending out from the periphery of said ferrite core.

26. The transformer as set forth in claim 22, wherein said fixture is provided with terminal lugs that hold the inner winding extending out from the periphery of said ferrite core.

27. The transformer as set forth in claim 7, wherein said fixture is a dielectric member retaining electrically conductive terminal lugs which are electrically connected with said inner winding in an electrically insulating relation with said ferrite core.

28. The transformer as set forth in claim 27, wherein said fixture includes a plurality of legs which are inserted between said ferrite core and said inner winding at a plurality of spots around the end of said ferrite core.

29. The transformer as set forth in claim 1, wherein said ferrite core is formed at a portion adjacent its axial end with notches so as to form flanges between the respective notches and the end face of said ferrite core, said inner winding having its end wound around said notches as being pressed against said flanges so as to fix the end of said inner winding around the ferrite core.

30. The transformer as set forth in claim 29, wherein said notch has a bottom of which depth is greater towards the end face of said ferrite core.

31. The transformer as set forth in claim 29, wherein the ferrite core is configured to have an ellipsoidal cross-section.

32. The transformer as set forth in claim 29, wherein the outer winding is offset towards one axial end of inner winding to occupy one-half axial length of the inner winding or less.

* * * * *